United States Patent [19]

Renner et al.

[11] Patent Number: 5,061,216

[45] Date of Patent: Oct. 29, 1991

[54] IONIZATION CHAMBER DOSIMETER

[75] Inventors: Tim R. Renner; Mark A. Nyman, both of Berkeley; Ronald Stradtner, Kensington, all of Calif.

[73] Assignee: The United States of America as represented by the United States Department of Energy, Washington, D.C.

[21] Appl. No.: 509,121

[22] Filed: Apr. 16, 1990

[51] Int. Cl.[5] ..... H01J 47/04

[52] U.S. Cl. ..... 445/28; 427/97; 427/241

[58] Field of Search ..... 445/28, 35; 427/97, 427/241; 204/15, 35.1, 20

[56] References Cited

U.S. PATENT DOCUMENTS

| | | | |
|---|---|---|---|
| 3,359,132 | 12/1967 | Wittmann | 427/241 X |
| 3,661,638 | 5/1972 | Lemecha | 427/97 |
| 4,124,411 | 11/1978 | Meuleman et al. | 427/241 X |
| 4,532,152 | 7/1985 | Elarde | 427/97 |
| 4,613,313 | 9/1986 | Steele | 445/28 |
| 4,682,964 | 7/1987 | Steele et al. | 445/28 |
| 4,715,917 | 12/1987 | Tirell et al. | 156/250 |

*Primary Examiner*—Kenneth J. Ramsey

*Attorney, Agent, or Firm*—L. E. Carnahan; Roger S. Gaither; William R. Moser

[57] ABSTRACT

A method for fabricating an ion chamber dosimeter collecting array of the type utilizing plural discrete elements formed on a uniform collecting surface which includes forming a thin insulating layer over an aperture in a frame having surfaces, forming a predetermined pattern of through holes in the layer, plating both surfaces of the layer and simultaneously tilting and rotating the frame for uniform plate-through of the holes between surfaces. Aligned masking and patterned etching of the surfaces provides interconnects between the through holes and copper leads provided to external circuitry.

3 Claims, No Drawings

IONIZATION CHAMBER DOSIMETER

The United States Government has rights in the invention pursuant to Contract No. DE-AC03-76SF00098 awarded by the U.S. Department of Energy.

BACKGROUND OF THE INVENTION

The present invention relates to a method for fabricating an ionization chamber dosimeter for measuring charges produced in correlation with radiation dose, and more specifically to a method for fabricating an ionization chamber dosimeter having collecting arrays of a high density type utilizing plural discrete elements uniformly formed on a collecting surface.

Although methods for fabricating ion chamber dosimeter collecting arrays are known, they require painstaking hand wiring, and are useful only for low density arrays while providing low reliability. Moreover, as higher and higher density arrays are required to achieve higher instrument resolution the presently known fabrication techniques are hopelessly inadequate.

SUMMARY OF THE INVENTION

Therefore, it is an object of the present invention to provide an improved method for fabricating highly reliable ion chamber dosimeter arrays which will overcome the above noted disadvantages.

It is a further object of the present invention to provide a method for fabricating an ionization chamber dosimeter collecting array of high density utilizing densely packed plural discrete elements.

A further object of the present invention is to provide a method for fabricating a precisely positioned array of discrete elements which simultaneously defines the electrical transition from each element to a predetermined lead means connector.

Yet, a further object of the present invention is to provide a method for fabricating an ionization chamber dosimeter collecting array of enhanced stability and reliability.

DISCUSSION OF THE INVENTION

The foregoing objects and others are accomplished in accordance with the present invention, generally speaking, by providing a frame of, for example, a conventional epoxy circuit board material of the order of about 15 inches square. An aperture is cut in the frame of sufficient size, while retaining sufficient edge stock of about $2\frac{3}{4}$ inches having formed thereon plural edge connectors having multiple lead contacts. These lead contacts may be conventionally formed of solder eyelets or other well known interconnection means to receive commercially available connectors.

Next, a thin insulating layer, such as 1 mil Kapton, a radiation hardened Mylar, is formed over the aperture and retained taut to the epoxy frame. The insulating layer presents a collection surface and a trace surface. A predetermined pattern of through holes are drilled through the insulating layer in each of a multiplicity of electrically conductive discrete elements to be formed on the collection surface of the insulating layer. The holes are drilled for example to a diameter of about 9 mm. Both the collection and trace surfaces of the insulating layer are plated to form layers of gold of the order of 2000 Å, while simultaneously tilting and rotating the frame to achieve uniform plating of the plural through holes, extending from the collection surface to the trace surface.

A mask defining the discrete elements is placed and aligned on the plated collection surface. Conventional gold etching is then utilized to isolate and form the discrete elements. An additional mask defining the trace pattern is placed on the trace surface. The trace mask defines contiguous interconnecting paths between each of the discrete elements and the connector lead means. Finally, the resulting array is placed in an ion chamber body and connected to an external apparatus.

The ionization chamber dosimeter collecting array of the present invention is most useful in treating patient tumors using radiation. Using the ion chamber collecting array energy is precisely localized within the patient's tumor to effectively destroy the tumor yet cause relatively little damage to surrounding healthy tissue. To verify radiation dosage the dosimeter array prepared according to the method of the present invention is positioned adjacent the patient to receive radiation at the discrete measurement elements. The number of discrete elements determines the measurement resolution, with all elements precisely arrayed along a surface to receive the radiation. An element-receiving area of the order of 5 mm×5 mm or less is desirable for high resolution. Prior art arrays cannot physically and reliable approach these dimensions. The present invention easily realizes 2 mm wide elements and makes larger arrays a physical reality.

The method for fabricating the precisely positioned array of discrete elements of the present invention, also simultaneously defines the electrical transition from each element to a predetermined lead means connector. The arrays fabricated according to the present invention are much more reliable and more stable in use compared to those prior art arrays using painstaking hand wiring techniques.

The method of the present invention can be applied to fabrication of large area ionization detectors, and small area detectors, as well as multi-element ionization detectors, with no limit on the number or shape of the elements except for the limitations imposed by the number of wire traces necessary to carry the output signals. The dosimeter allows for the detection of the ionization caused by the primary radiation with insignificant interference. The detector system is operated in a "transmission mode" and consequently is unobtrusive. This allows the detectors to operate between the radiation source and the target. The technology is readily adaptable to any kind of multi-element ionization detector geometry utilizing parallel planes. Examples include detectors with a cross sectional area in the shape of rings, circles, squares, or hexagons. The use of this technology is practically suited for use with photon and charged particle radiation.

The present invention provides a method for fabricating a thin insulating layer structure, transparent to a beam of energy which passes through the insulating layer continuing onward to the patient or target. The thin insulating layer carries or supports discrete elements on the collection surface and interconnecting trace patterns on the trace surface, which do not obstruct the beam, smoothly and mechanically connecting to copper leads for external circuitry. The step of plating the surfaces while simultaneously tilting and rotating the frame for uniform plate-through ensures that a highly reliable electrical continuity is provided. The same step of plating the collection and trace surfaces uniformly plates all the way out to include the leads and further ensures reliability and repeatability in yield and resolution, particularly as the number of elements increase in a given array size.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method for fabricating an ionization chamber dosimeter collecting array for the purpose of measuring radiation dose delivered to a patient which comprises:

providing at least one frame having top and bottom surfaces with an aperture formed therein surrounded by an edge portion, forming plural edge connectors having multiple lead contacts on opposite edges of said frame, forming a thin insulating layer over the aperture of said frame, said insulating layer having a collection surface and a trace surface, providing a predetermined pattern of through holes in said insulating layer, plating both said collection surface and trace surface of said insulating layer, simultaneously tilting and rotating said frame, so as to form layers of gold on said respective collection and trace surfaces and to uniformly plate said through holes extending from said collection surface to said trace surface, selectively masking and pattern etching said plated collection surface of said insulating layer to form a multiplicity of electrically conductive discrete elements thereon having provided therein said uniformly plated through holes, and selectively masking and pattern etching said plated trace surface of said insulating layer to form a trace pattern defining contiguous interconnecting paths between each of said discrete elements and said plural edge connectors.

2. The method of claim 1, further including providing two such ionization chamber dosimeter arrays with facing collection surfaces and providing a high voltage foil between each of said arrays.

3. The method of claim 1, wherein said frame comprises an epoxy circuit board.

* * * * *